US006655359B2

(12) United States Patent
Hasegawa et al.

(10) Patent No.: US 6,655,359 B2
(45) Date of Patent: Dec. 2, 2003

(54) METHOD OF OPERATING VEHICULAR INTERNAL COMBUSTION ENGINE OF AN INTERMITTENT-OPERATION TYPE

(75) Inventors: Keiko Hasegawa, Susono (JP); Toshio Inoue, Gotenba (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/121,578

(22) Filed: Apr. 15, 2002

(65) Prior Publication Data

US 2002/0157651 A1 Oct. 31, 2002

(30) Foreign Application Priority Data

Apr. 27, 2001 (JP) ..... 2001-132995

(51) Int. Cl.[7] ..... F02D 41/06
(52) U.S. Cl. ..... 123/491; 123/179.4; 123/179.16
(58) Field of Search ..... 123/491, 179.4, 123/179.16

(56) References Cited

U.S. PATENT DOCUMENTS 4,377,137 A * 3/1983 Amano et al. ..... 123/491
4,691,680 A * 9/1987 Staerzl ..... 123/491
4,735,184 A * 4/1988 Kasanami et al. ..... 123/491
5,394,857 A * 3/1995 Yamakawa ..... 123/491
2002/0189595 A1 * 12/2002 Iwasaki ..... 123/491
2003/0000509 A1 * 1/2003 Larsen ..... 123/491

FOREIGN PATENT DOCUMENTS

JP A 2000-54826 2/2000
JP A 2000-104588 4/2000
JP A 2000-220496 8/2000

* cited by examiner

*Primary Examiner*—Erick Solis
(74) *Attorney, Agent, or Firm*—Oliff & Berridge, PLC

(57) ABSTRACT

A temporary increase in an amount of fuel at start of an engine is controlled on the basis of an estimated amount of fuel that has adhered to the perimeter of intake ports at start of the engine. If the engine is restarted soon after being stopped, the increase in the amount of fuel is reduced by a correction amount that is reduced gradually with the lapse of time. If only a considerably short length of time has elapsed, the amount of fuel is not increased. If the engine is started twice within a short period, the increase in the amount of fuel at the latter start of the engine changes continuously from the increase in the amount of fuel at the former start of the engine.

12 Claims, 6 Drawing Sheets

METHOD OF OPERATING VEHICULAR INTERNAL COMBUSTION ENGINE OF AN INTERMITTENT-OPERATION TYPE

INCORPORATION BY REFERENCE

The disclosure of Japanese Patent Application No. 2001-132995 filed on Apr. 27, 2001 including the specification, drawings and abstract is incorporated herein by reference in its entirety.

BACKGROUND OF THE INVENTION

1. Field of Invention

The invention relates to a method of operating a vehicular internal combustion engine. In particular, the invention relates to a method of operating a vehicular internal combustion engine that is of an intermittent-operation type, namely, that is designed to be stopped temporarily if a vehicle-operating condition for temporarily stopping the internal combustion engine is fulfilled while the vehicle is running.

2. Description of Related Art

When a vehicular internal combustion engine is started, the amount of fuel is increased temporarily. Such a temporary increase in the amount of fuel at start of an engine aims mainly at temporarily thickening the mixture at start of the engine and thereby improving the startability of the engine. However, some modern vehicles are equipped with an exhaust-gas purification catalyst that captures oxygen upon stoppage of an engine, thus preventing the function of purifying NOx from being lost at start of the engine. Also, attention has been given to a technique of temporarily increasing the amount of fuel at start of an engine so that an exhaust-gas purification catalyst in which oxygen is captured will be reduced by being supplied with combustible components such as CO and HC at start of the engine.

In the case of various types of vehicles including: conventional vehicles, economy running vehicles, and hybrid vehicles, an engine is stopped by stopping the supply of fuel. However, even after the supply of fuel to the engine has been stopped, the engine keeps rotating idly a couple of times before coming to a complete halt. During such idle rotation of the engine, combustion chambers are supplied with only oxygen without being supplied with fuel. Accordingly, the exhaust-gas purification catalyst is supplied with oxygen and then captures it. Conventional vehicles, economy running vehicles, and hybrid vehicles are almost identical in that a catalyst captures oxygen as soon as an engine is stopped. However, in the case of economy running vehicles and hybrid vehicles, an engine is quite frequently stopped temporarily and then restarted. Therefore, it is far more crucial for economy running vehicles and hybrid vehicles than for conventional vehicles to suitably perform a reduction treatment of an exhaust-gas purification catalyst at start of an engine, namely, to temporarily increase the amount of fuel in order to sufficiently reduce the catalyst without allowing combustible components such as CO and HC to be discharged into the atmosphere.

In addition, economy running vehicles and hybrid vehicles encounter a problem peculiar to a temporary increase in the amount of fuel at start of an engine. In many gasoline engines that are designed to supply fuel by means of a carburetor or injection through ports, the problem is associated with a phenomenon in which part of supplied fuel adheres to the perimeter of intake ports and forms a liquid-fuel membrane. That is, while an engine that is designed to supply fuel by means of a carburetor or injection through ports is in operation, a liquid-fuel membrane of a substantially constant thickness is formed in the perimeter of intake ports. A considerable amount of fuel is used to form the liquid-fuel membrane.

Thus, the amount of fuel required for formation of the aforementioned liquid-fuel membrane must be taken into account in order to satisfactorily perform a reduction treatment of the exhaust-gas purification catalyst at start of the engine and temporarily increase the amount of fuel at start of the engine by an amount that is controlled to prevent combustible components of a surplus of fuel from being discharged into the atmosphere. Mostly in the case of conventional vehicles in which an engine is started only at takeoff, the aforementioned liquid-fuel membrane no longer exists at start of the engine. However, in many cases of economy running vehicles and hybrid vehicles in which an engine is stopped temporarily during traveling and restarted after a while, a liquid-fuel membrane substantially remains at start of the engine. In addition, the degree of residence of the liquid-fuel membrane differs depending on the length of elapsed time. If the increase in the amount of fuel at restart of the engine is always constant in such a case, the amount of added fuel that is introduced into combustion chambers fluctuates greatly. As a result, the amount of combustible components of fuel to be supplied to perform a reduction treatment of the exhaust-gas purification catalyst may become insufficient. Also, the atmospheric environment may be contaminated if combustible components of fuel are supplied in an excessive amount and discharged into the atmosphere.

SUMMARY OF THE INVENTION

It is an objective of the invention to provide a method of operating a vehicular internal combustion engine as an appropriate solution to the aforementioned problems which occur when the amount of fuel is increased at start of an engine. In order to achieve the aforementioned objective, a method of operating a vehicular internal combustion engine according to an aspect of the invention is designed such that an initial value of an increase in an amount of fuel at restart of the internal combustion engine is reduced from a predetermined standard value if a time that elapses from a timing when the internal combustion engine is started to a timing when the internal combustion engine is stopped temporarily is shorter than a predetermined value.

Further, an initial value of an increase in an amount of fuel at restart of the internal combustion engine is reduced from the predetermined standard value if an amount of air that flows through intake ports of the internal combustion engine from a timing when the internal combustion engine is started through a period in which the internal combustion engine is stopped temporarily is smaller than a predetermined value.

Furthermore, the amount of fuel at restart of the internal combustion engine is not increased if a time that elapses from a timing when the internal combustion engine is stopped to a timing when the internal combustion engine is restarted is shorter than a predetermined value.

If the increase in the amount of fuel at start of the engine is controlled on the basis of an estimated amount of fuel that has adhered to the perimeter of intake ports at start of the engine, the amount of fuel can be appropriately increased even in the case where the liquid-fuel membrane in the perimeter of the intake ports takes different states at start of the engine as in the case of economy running vehicles and hybrid vehicles and where the amount of fuel required for restoration of the liquid-fuel membrane may vary.

DETAILED DESCRIPTION OF EXEMPLARY EMBODIMENTS

A method of operating an internal combustion engine according to embodiments of the invention will be described hereinafter in detail.

Figure 1:
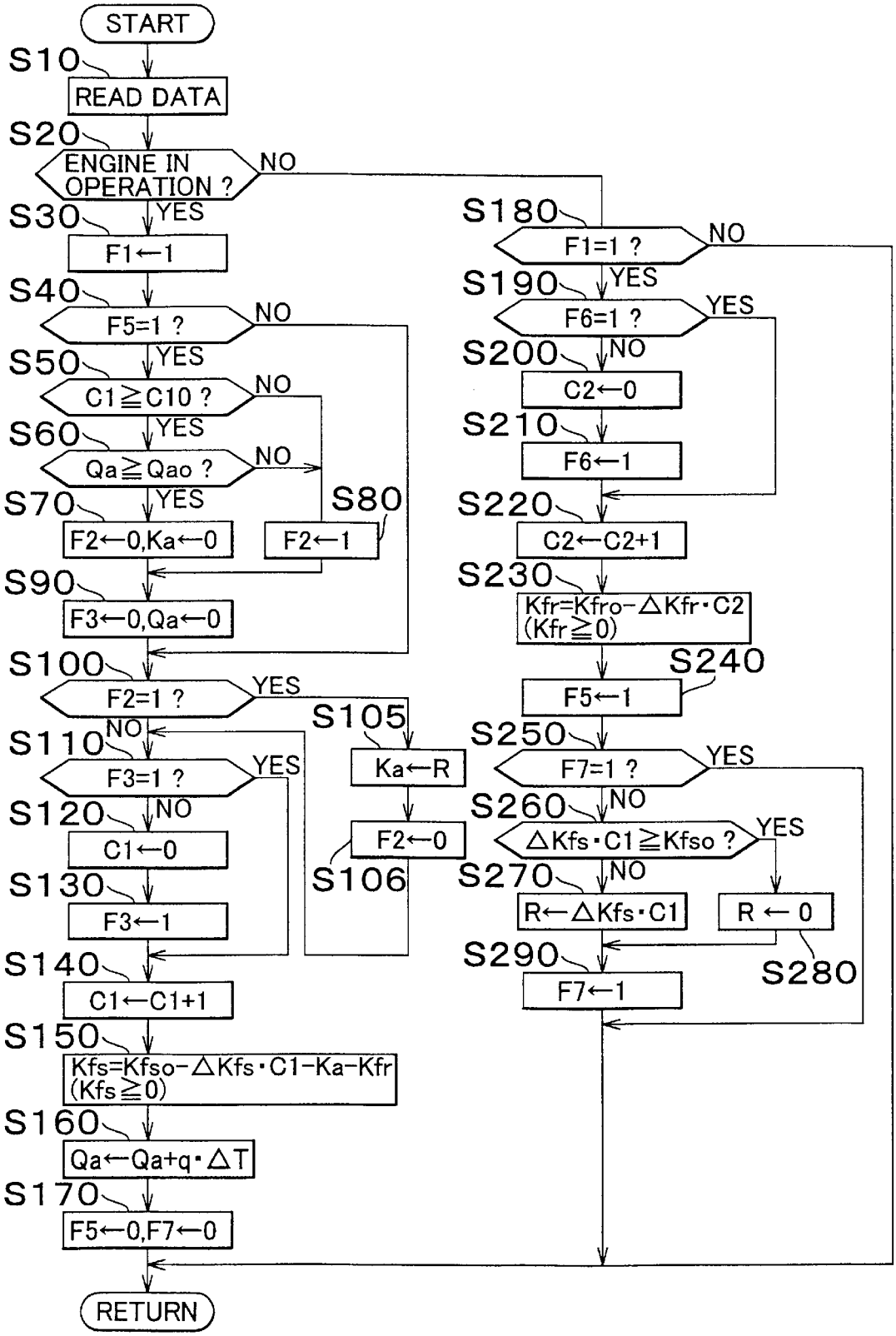
FIG. 1 is a flowchart showing a method of operating a vehicular internal combustion engine according to one embodiment of the invention.

FIG. 1 is a flowchart showing the first embodiment of the invention as a continuous series of control routines. Operation control of a vehicular internal combustion engine based on this flowchart is started as soon as a vehicle is started by turning a key switch (not shown) on.

After the commencement of control, data required for the performance of control is read in step S10. It is then determined in step S20 whether or not the internal combustion engine is in operation.

In starting to drive the vehicle, a driver of the vehicle determines whether or not the engine is to be operated. However, while the vehicle is running, a vehicular automatic driving system equipped with a controller (not shown) determines whether or not the engine is to be operated. This may be carried out through any one of the determinations that are made during control on the basis of an operational state of the vehicle and that are grounded on various propositions already made in this technical field. Depending on whether the engine is in operation or stopped temporarily through an arbitrary one of such engine-operation control procedures, the result in step S20 turns out to be positive or negative, respectively.

A control procedure of this type as represented by a flowchart is performed repeatedly at intervals of about several tens of microseconds. Accordingly, if the result in step S20 is positive during a control routine and negative in the subsequent control routine, it follows that the engine has been stopped temporarily due to a switch of operation within several tens of microseconds. On the contrary, if the result in step S20 is negative a during control routine and positive in the subsequent control routine, it follows that the temporarily stopped engine is restarted at that moment.

If the result in step S20 is positive, F1 is set as 1 in step S30. It is then determined in step S40 whether or not F5 has been set as 1. At the commencement of control, F5 is reset as 0. As is well known in this technical field, F5 is reset as 0 at the commencement of control, and is reset again as 0 in later-described step S170 or set as 1 in later-described step S240. Accordingly, if step S40 is reached for the first time after the commencement of control or if step S40 is reached through steps S10, S20, and S30 after the return from step S170, F5 is 0. Thus, the result in step S40 is negative. If the sub-routine in step S40 is performed for the first time after start of the engine following the performance of the sub-routines in steps S180 to S270 during stoppage of the engine as will be described later, F5 is 1. Thus, the result in step S40 is positive. First of all, the control procedure is made to proceed as to the case where the result in step S40 is positive.

It is then determined in step S50 whether or not a count value C1 indicating a time that has elapsed after start or restart of the engine is equal to or greater than a predetermined threshold value C10. This count value C1 is also reset as 0 at the commencement of control. Thereafter, the count value C1 is reset in later-described step S120 or increased by 1 in step S140. The sub-routine in step S50 is designed to determine whether or not a predetermined time or more has elapsed after start or restart of the engine. If the result in step S50 is positive, it is then determined in step S60 whether or not a cumulative value Qa of the amount of air flowing through the internal combustion engine is equal to or greater than a predetermined threshold value $Qa_0$. The cumulative value Qa of the amount of air is also reset as 0 at the commencement of control, and is reset as 0 in later-described step S90. In step S160, the cumulative value Qa of the amount of air is increased by an amount of air flowing through the internal combustion engine during one cycle of this flowchart, thus indicating a cumulative value of the amount of flowing air after start or restart of the engine. The sub-routine in step S60 is also designed to determine whether or not the internal combustion engine has been operated to such an extent that air of a predetermined cumulative amount flows after the start or restart of the engine. It is appropriate that the count value C1 and the cumulative value Qa of the amount of air not be increased further after reaching values suited to achieve objectives of the respective determinations. If both the result in step S50 and the result in step S60 are positive, F2 and a later-described parameter Ka are reset as 0 in step S70. On the other hand, if either the result in step S50 or the result in step S60 is negative, F2 is set as 1 in step S80.

Even in the case where the sub-routine in steps S70 or S80 is performed, the sub-routine in step S90 is then performed. In step S90, F3 is reset as 0, and the aforementioned cumulative value Qa of the amount of air is also reset as 0. The sub-routine in step S100 is then performed.

If the result in step S40 is negative, the sub-routines in steps S50 to S90 are skipped, and the sub-routine in step S100 is performed immediately. It will be described later why the control sub-routine proceeds differently depending on the value of F5.

It is determined in step S100 whether or not F2 is 1. If the result in step S100 is negative, it is determined in step S50 that such a sufficient length of time has elapsed that the count value C1 indicating a time that has elapsed after the start or restart of the engine becomes equal to or greater than the threshold value C10. If it is determined in step S60 that the engine has been operated to such an extent that a sufficient amount of air flows through the engine so that the cumulative value Qa of the amount of air flowing through the engine becomes equal to or greater than the threshold value $Qa_0$, the sub-routine in step S110 is performed. On the other hand, if F2 is 1, that is, either if the count value C1 has not reached the threshold value C10 or if the cumulative value Qa of the amount of air has not reached the threshold value $Qa_0$, the sub-routine in step S105 is performed. In step S105, the parameter Ka is set as R, which is calculated in later-described step S270. The sub-routine in step S106 is then performed to reset F2 as 0.

It is determined in step S50 whether or not the count value C1 is equal to or greater than the predetermined threshold value, and it is determined in step S60 whether or not the cumulative value of the amount of air flowing through the engine is equal to or greater than the predetermined threshold value. Taking both the conditions into account, it is determined whether F2 is to be set as 0 or 1. That is, it is determined whether or not the predetermined time has elapsed after the start or restart of the engine. Alternatively, it is determined whether or not the predetermined amount of operation has been exceeded after the start or restart of the engine. This determination is made so as to make a more reliable determination on the substantial operation of the engine after the start or restart thereof.

The following sub-routines in steps S110, S120, and S130 are designed such that the count value C1 for measuring a time that has elapsed after the start or restart of the engine is first reset as 0 if the result in step S20 is positive. After the count value C1 is first reset as 0, the sub-routine in step S140 is performed. Every time the control procedure passes through the sub-routine in step S140, the count value C1 is increased by 1. Thereby, a time that has elapsed after the start or restart of the engine is measured.

A fuel-amount incremental coefficient Kfs for increasing an amount of fuel during the start or restart of the engine is then calculated in step S150. The fuel-amount incremental coefficient Kfs is first set as a certain initial value and is then reduced by a predetermined coefficient decrement $\Delta Kfs \cdot C1$ every time a certain time elapses. The initial value is a predetermined value $Kfs_0$, a value obtained by subtracting Ka from $Kfs_0$ when the parameter Ka is not 0, or a value obtained by further subtracting a later-described coefficient value Kfr calculated in step S230 from $(Kfs_0-Ka)$ when the coefficient value Kfr is not 0. This fuel-amount incremental coefficient Kfs indicates a degree to which the amount of fuel is increased during the start or restart of the engine. An increase in the amount of fuel is calculated by multiplying a standard fuel injection amount by this coefficient.

The cumulative value Qa of the amount of air is then increased in step S160 by an amount $q \cdot \Delta T$ of air that is added during one cycle of the present routine. It is to be noted herein that q is an amount of air flowing per unit time and that $\Delta T$ is a short length of time that has elapsed during one cycle of the present routine. The sub-routine in step S170 is then performed to reset F5 and F7 as 0.

Figure 2:
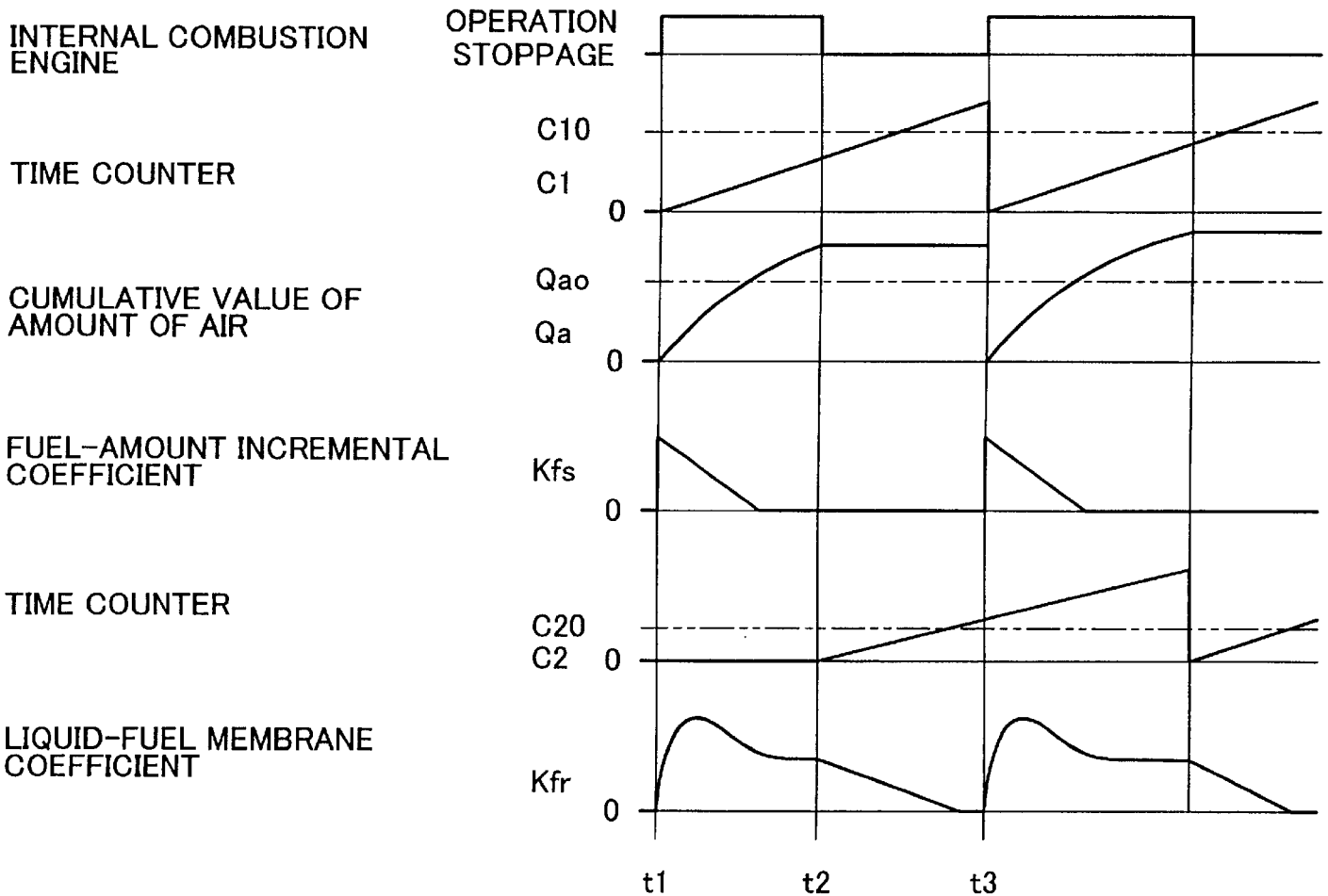
FIG. 2 is a diagram showing an example of engine-operation control performed in accordance with the flowchart shown in FIG. 1.

FIG. 2 is a graph showing, for example, how the operational state of an internal combustion engine to which the control procedure shown in FIG. 1 is applied, the count value C1 changing during the control procedure, the cumulative value Qa of the amount of air, the fuel-amount incremental coefficient Kfs, and another count value C2 described below, and a liquid-fuel membrane coefficient Kfr change. If operation of the engine is started at a timing t1 as described above, the count value C1 is increased from 0 with the lapse of time. The cumulative value Qa of the amount of air is also increased from 0 in accordance with the cumulative value of the amount of air flowing through the engine. The fuel-amount incremental coefficient Kfs assumes its initial value $(Kfs_0-Ka-Kfr)$ at the timing t1 and is then reduced gradually with the lapse of time. The counting of the other count value C2 has not been started yet at the timing t1. The liquid-fuel membrane coefficient Kfr indicates the thickness of a liquid-fuel membrane that has adhered to the perimeter of intake ports. If fuel injection is started during the start of the engine, the liquid-fuel membrane coefficient Kfr increases temporarily and abruptly. However, in the course of operation of the engine, the liquid-fuel membrane coefficient Kfr stabilizes at a substantially constant value. If operation of the engine is stopped, the liquid-fuel membrane coefficient Kfr is reduced gradually from a value at that moment with the lapse of time.

As shown in FIG. 2, it is assumed that the engine is started or restarted at the timing t1, operated until a timing t2, and stopped temporarily at the timing t2. In this case, the sub-routine in step S40 is performed following the sub-routines in steps S10, S20, and S30. Furthermore, the sub-routines in steps S50 to S100 are performed and the sub-routine in step S110 is then performed. Only during the first cycle of the present routine, the sub-routine in step S120 is then performed to reset the count value C1 as 0. Thereafter, the sub-routine in step S140 is performed immediately after the sub-routine in step S110. Thereby, the control procedure circulates through steps S150, S160, and S170. Accordingly, the count value C1, the cumulative value Qa of the amount of air, and the fuel-amount incremental coefficient Kfs are calculated with the lapse of time as shown in FIG. 2.

If the engine is stopped temporarily at the timing t2, the result in step S20 is negative. Thus, it is then determined in step S180 whether or not F1 is 1. If the engine has not been started even once while the key switch of the vehicle remains on, F1 has been reset as 0 since the commencement of the control procedure. If the result in step S180 is negative, the control procedure is immediately started again and the sub-routine in step S10 is performed to await the start of the engine while updating data that have been read. However, since F1 is set as 1 during last execution of the present routine, the result in step S180 is positive if the sub-routine in step S180 is performed at the timing t2. The sub-routine in step S190 is then performed. The sub-routine in step S200 is then performed to first reset the count value C2 as 0. In the sub-routine in step S210, F6 is set as 1. As the control procedure thereafter circulates in this manner, the count value C2 is increased by 1 in step S220, so that a time that elapses during one cycle of the control procedure, namely, a time that has elapsed since the stoppage of operation of the engine is measured. Thus, the count value C2 is increased gradually after the timing t2 as shown in FIG. 2.

The liquid-fuel membrane coefficient Kfr indicating the thickness of a liquid-fuel membrane that has adhered to the perimeter of the intake ports is then calculated in step S230 according to an equation $Kfr=Kfr_0-\Delta Kfr_0 \cdot C2$. That is, the liquid-fuel membrane coefficient Kfr first assumes its initial value $Kfr_0$ and is then reduced gradually with the lapse of time. FIG. 2 shows how the liquid-fuel membrane coefficient Kfr changes.

The sub-routine in step S240 is then performed to set F5 as 1. This indicates that the sub-routine in step S240 has been performed, namely, that the engine has been stopped. It is then determined in step S250 whether or not F7 is 1. If the sub-routine in step S250 is performed for the first time after the result in step S180 turns out to be positive, F7 has been reset as 0. Therefore, it is then determined in step S260 whether or not a decrement $\Delta Kfs \cdot C1$ for the fuel-amount incremental coefficient Kfs has reached the initial value $Kfs_0$ of the fuel-amount incremental coefficient Kfs. If the result in step S260 is negative, the decrement $\Delta Kfs \cdot C1$ is recorded as a parameter R in step S270. If the result in step S260 is positive, the parameter R is reset as 0 in step S280. The parameter R is converted into the parameter Ka in step S105 and is used to calculate the fuel-amount incremental coefficient Kfs in step S150. In the example shown in FIG. 2, the fuel-amount incremental coefficient Kfs has already reached 0 at the timing t2, and the decrement ΔKfs·C1 has already exceeded the initial value $Kfs_0$ at the timing t2. Therefore, the result in step S260 is positive, and the parameter R is reset as 0.

If the engine is restarted at a timing t3 after time has elapsed further during temporary stoppage of the engine, the result in step S20 becomes positive. The sub-routine in step S30 is then performed again, and the sub-routine in step S40 follows. Because F5 is set as 1 in step S40, it is then determined in step S50 whether or not the count value C1 is greater than the predetermined threshold value C10. In the example shown in FIG. 2, since the count value C1 is greater than the threshold value C10 at the timing t3, the result in step S50 is positive. It is then determined in step S60 whether or not the cumulative value Qa of the amount of air is greater than the predetermined value $Qa_0$. In the example shown in FIG. 2, since the cumulative value Qa is also greater than the predetermined value $Qa_0$, the result in step S60 is positive. The sub-routine in step S70 is then performed to reset both F2 and the parameter Qa as 0. Accordingly, the sub-routine in step S100 shifts immediately to the sub-routine in step S110, and the sub-routine in step S105 is skipped. Therefore, the parameter Ka remains equal to 0 after being reset as 0 in step S70. In the example shown in FIG. 2, the liquid-fuel membrane coefficient Kfr calculated in step S230 is also 0 at the timing t3. Therefore, the fuel-amount incremental coefficient Kfs is calculated in step S150 as a value that first assumes the prescribed initial value $Kfs_0$, and that is then reduced gradually with the lapse of time.

In this manner, if the engine is operated until the influence of an increase in the amount of fuel in the initial stage of the start of the engine is eliminated (C1>C10, $Qa>Qa_0$), and if the engine remains stopped until the liquid-fuel membrane in the perimeter of the intake ports disappears (Kfr=0), the amount of fuel at restart of the engine is increased according to a standard procedure. That is, the increase in the amount of fuel first assumes the standard initial value $Kfs_0$ and is then reduced gradually with the lapse of time. The standard increase in the amount of fuel at start of the engine contributes to an improvement in the startability of the engine. By suitably performing a reduction treatment of an exhaust-gas purification catalyst at start of the engine without discharging combustible components of fuel into the atmosphere, it becomes possible to continue to drive an economy running vehicle or a hybrid vehicle on the basis of intermittent operation of the engine. In the embodiment described with reference to FIGS. 1 and 2, the increase in the amount of fuel at start of the engine first assumes a certain initial value and is then reduced gradually as time elapses after last stoppage of the engine. However, if operation of the engine is switched with a sufficient length of time left between a timing when the engine is stopped and a timing when the engine is started, it is not indispensable that the increase in the amount of fuel be changed gradually with the lapse of time. It is also appropriate that the amount of fuel be increased at a certain rate over a certain period.

Figure 3:
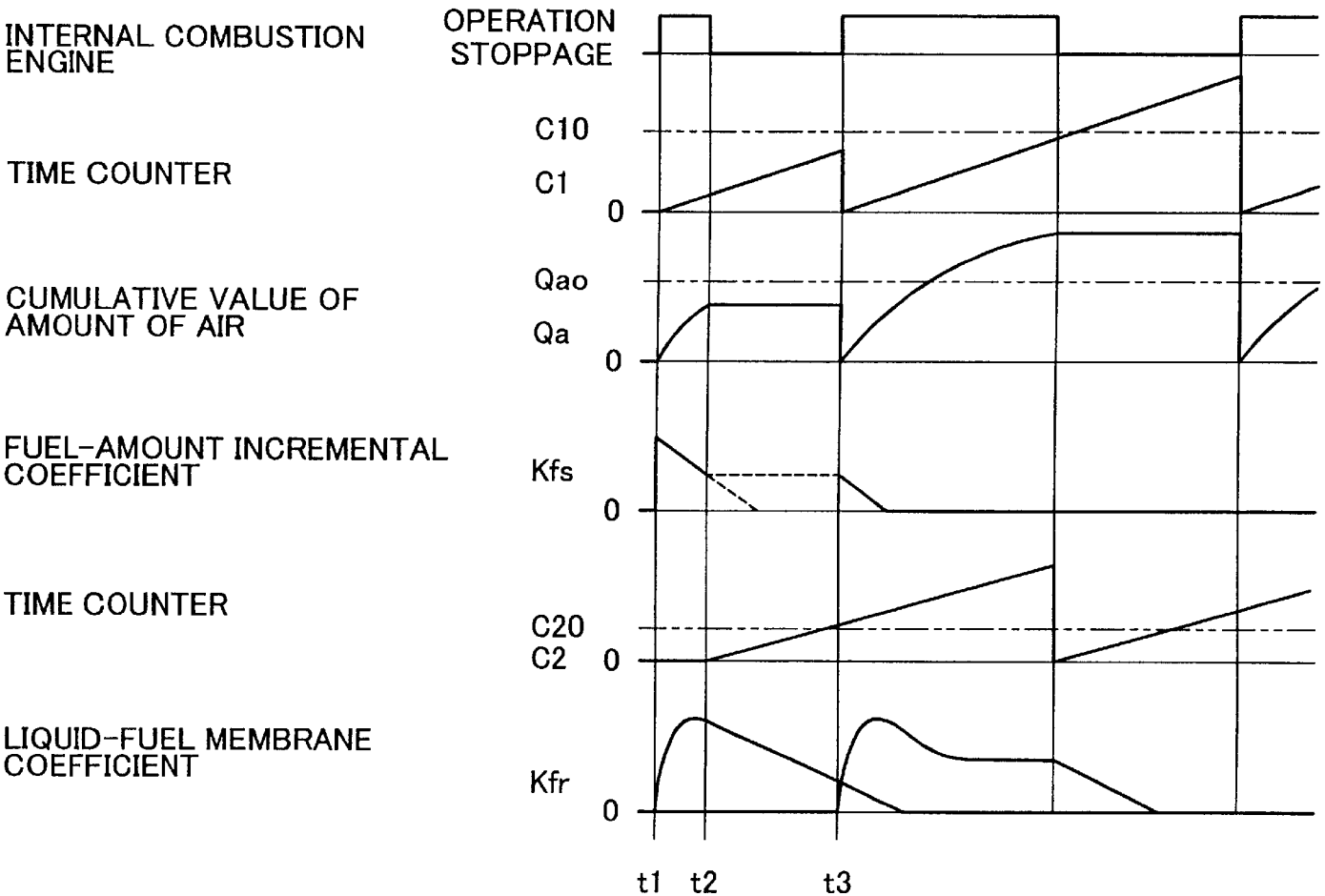
FIG. 3 is a diagram similar to FIG. 2, showing another example of operation control.

FIG. 3 is a diagram similar to FIG. 2, showing another example of the operational states of the vehicle. In this example, the engine is started at the timing t1. After being operated for a considerably short period, the engine is stopped temporarily at the timing t2 and then restarted at the timing t3. The period in which the engine is operated, namely, the period between the timing t1 and the timing t2 is short. The subsequent period in which the engine is stopped temporarily, namely, the period between the timing t2 and the timing t3 is not very long. Accordingly, the count value C1, which starts being counted at the timing t1, has not reached the threshold value C10 at the timing t3. The cumulative value Qa of the amount of air, which starts being cumulated at the timing t1, has not reached the threshold value $Qa_0$ at the timing t3 either. If the engine is thus stopped after being started and operated for a short period, a thick liquid-fuel membrane remains in the perimeter of the intake ports. It takes the liquid-fuel membrane a correspondingly long time to disappear. In such a situation, if the engine is started at an early stage and if the amount of fuel at start of the engine is increased as usual, there arises a fear that the increase in the amount of fuel at start of the engine may become excessive.

In such a case, however, the result in step S20 becomes positive, so that the sub-routines in steps S30, S40 are performed. If the result in steps S50 or S60 turns out to be negative, the sub-routine in step S80 is performed to set F2 as 1. Thus, the result in step S100 turns out to be positive, and the sub-routine in step S105 is performed to substitute R into the parameter Ka. The value R is equal to ΔKfs·C1 that is calculated in step S270 on the basis of the count value C1 at the last moment of the period in which the engine is stopped temporarily. This value is subtracted from the standard initial value $Kfs_0$ in calculating the fuel-amount incremental coefficient Kfs in step S150. Accordingly, in the case where the engine is restarted at the timing t3, the fuel-amount incremental coefficient Kfs first assumes the value at the timing t2 when the engine is stopped, and is then reduced gradually with the lapse of time, as is apparent from FIG. 3.

In the embodiment shown in FIG. 1, when calculating the fuel-amount incremental coefficient Kfs in step S150, the aforementioned Ka and the liquid-fuel membrane coefficient Kfr calculated in step S230 are subtracted from the initial value $Kfs_0$. It is to be noted, however, that some measures that can be adopted in the invention are incorporated into the flowchart shown in FIG. 1 in a comprehensive manner. As regards calculation of the fuel-amount incremental coefficient Kfs in step S150, there may be an embodiment in which either the parameter Ka or the fuel-amount incremental coefficient Kfr is omitted.

In the case where the engine is thus started, stopped after a while, and restarted before long, the increase in the amount of fuel at restart of the engine is reduced while the influence of the increase in the amount of fuel at start of the engine is taken into account. Thereby, it becomes possible to suitably increase the amount of fuel at restart of the engine.

Figure 4:
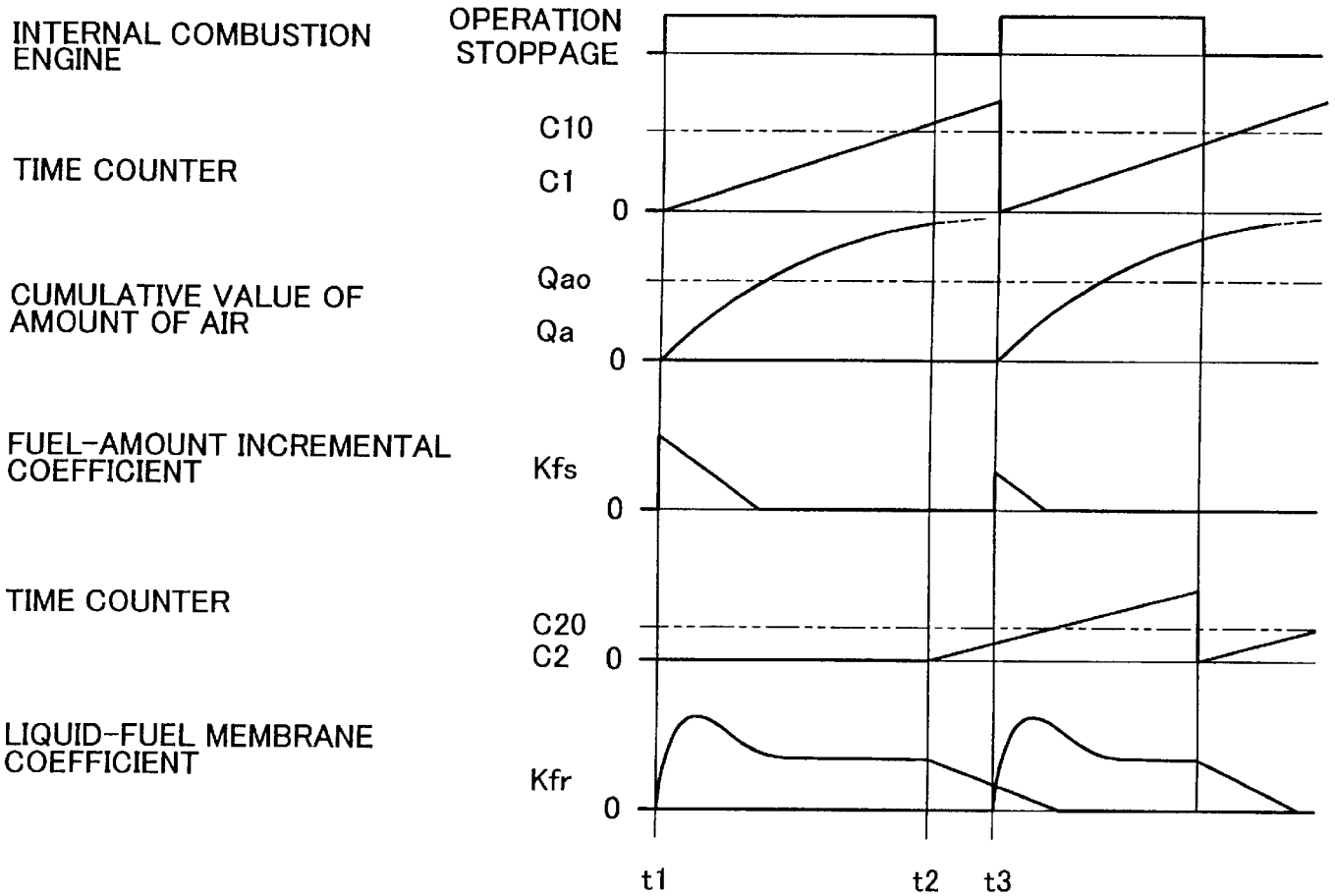
FIG. 4 is a diagram similar to FIGS. 2 or 3, showing still another example of operation control.

FIG. 4 is a diagram similar to FIGS. 2 or 3, showing another example of the operational states of the engine. This example illustrates a case where a thick liquid-fuel membrane is stabilized after being formed in the perimeter of the intake ports temporarily and abruptly after start of the engine and where the engine is then restarted after being stopped for a considerably short period. In this case, the engine, which is started at the timing t1, is operated, stopped temporarily at the timing t2, and restarted soon at the timing t3. In such a case, at the timing t2 when the engine is stopped, the liquid-fuel membrane in the perimeter of the intake ports is thinner in comparison with the case shown in FIG. 3. However, if the engine is restarted soon after the timing t2 when the engine is stopped, namely, at the timing t3, the liquid-fuel membrane coefficient Kfr still remains great. If the amount of fuel at start of the engine is increased as usual at this moment, it follows that the amount of fuel at start of the engine is too great.

As a countermeasure against such a problem, the embodiment shown in FIG. 1 is designed such that the counting of the count value C2 is started as soon as the engine is stopped. As the count value C2 is increased, the liquid-fuel membrane coefficient Kfr is calculated in step S230 as a value that first assumes the predetermined initial value $Kfr_0$ and that is then reduced gradually by $\Delta Kfr_0 \cdot C2$ which changes in accordance with the count value C2. The fuel-amount incremental coefficient Kfs that is calculated in step S150 during subsequent start of the engine is decreasingly corrected in accordance with the liquid-fuel membrane coefficient Kfr. Because of such a construction, if the engine is restarted before the liquid-fuel membrane coefficient Kfr calculated in step S230 becomes 0, the increase in the amount of fuel at start of the engine is decreasingly corrected correspondingly.

Figure 5:
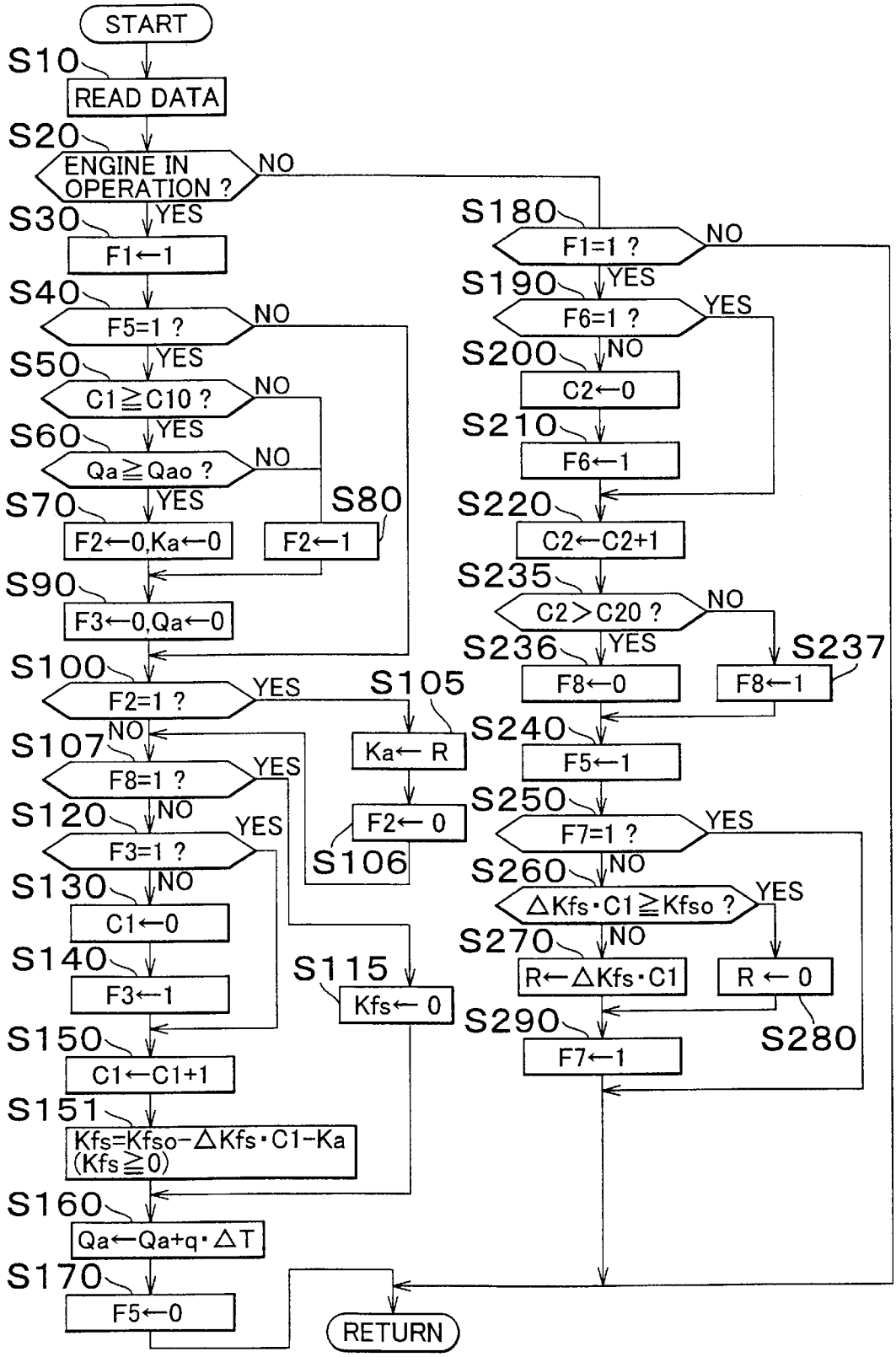
FIG. 5 is a flowchart showing a method of operating a vehicular internal combustion engine according to another embodiment of the invention.

FIG. 5 is a flowchart similar to FIG. 1, showing a method of operating the engine according to another embodiment of the invention. In the flowchart shown in FIG. 5, the sub-routines corresponding to those in FIG. 1 are denoted by the same reference numbers and play the same role respectively. In this embodiment, it is determined in step S235 whether or not the count value C2 is greater than a predetermined threshold value C20. If the period between a timing when the engine is stopped and a timing when the engine is restarted is so short that the count value C2 does not reach the threshold value C20, the sub-routine in step S237 is performed to set F8 as 1, instead of the sub-routine that is performed in step S236 to reset F8 as 0.

The value of F8 is confirmed in step S107. If F8 is 0, the sub-routines in steps S120 to S151 are performed, and the fuel-amount incremental coefficient Kfs is calculated in accordance with the count value C1 and the parameter Ka. If F8 is 1, the sub-routines in steps S120 to S151 are skipped and the sub-routine in step S115 is performed to set the fuel-amount incremental coefficient Kfs as 0. In other words, the amount of fuel is not increased.

If the engine is stopped and restarted soon after being started or is restarted soon after being stopped on the basis of a correction made to the aforementioned control for increasing the amount of fuel at start of the engine, the amount of fuel is increased as usual.

Accordingly, it is possible to reliably increase the amount of fuel at start of the engine by an amount required for a reduction treatment of the exhaust-gas purification catalyst while preventing combustible components of fuel such as CO and HC from being discharged into the atmosphere because of an excessive amount of fuel that is supplied to perform the reduction treatment of the exhaust-gas purification catalyst.

Figure 6:
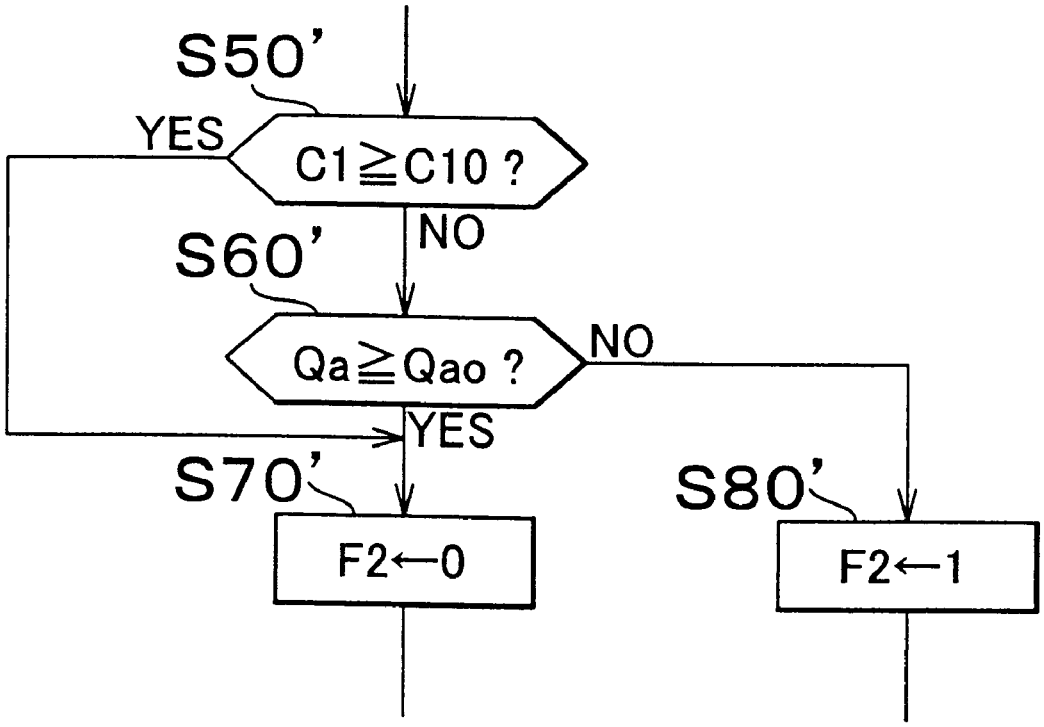
FIG. 6 shows an example of modifications made to some parts of the flowcharts shown in FIGS. 1 and 5.

In the embodiments shown in FIGS. 1 and 5, it is determined in step S70 that F2 is 0 if the time that has elapsed after start of the engine is equal to or longer than the predetermined threshold value in step S50 and if the cumulative value of the amount of air that has passed through the engine after start thereof is equal to or greater than the predetermined threshold value in step S60, and it is determined in step S80 that F2 is 1 if the time that has elapsed after start of the engine is equal to or shorter than the predetermined threshold value in step S50 or if the cumulative value of the amount of air that has passed through the engine after start thereof is equal to or smaller than the predetermined threshold value in step S60. However, it is for the purpose of reliably determining whether or not the engine has been operated substantially at least over a certain period after start of the engine that both the count value C1 and the cumulative value Qa of the amount of air flowing through the engine are used to make the aforementioned determination in the course of control. Accordingly, it is not indispensable that the determination based on these two parameters be made if both the condition regarding the count value C1 and the condition regarding the cumulative value Qa are fulfilled at the same time. That is, the determination may be made if at least one of the conditions is fulfilled. In this case, it is appropriate that the sub-routines in steps S50, S60, S70, and S80, shown in FIGS. 1 or 5, be modified to steps S50', S60', S70' and S80' as shown in FIG. 6.

In the illustrated embodiment, the controller can be implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

What is claimed is:

1. A method of operating a vehicular internal combustion engine which is designed to increase an amount of fuel temporarily at start, wherein:

if a time that elapses, from a timing when the internal combustion engine is started through a timing when the internal combustion engine is stopped temporarily and then to a timing when the internal combustion engine is restarted, is shorter than a predetermined value, the method of comprising the step of:

reducing an initial value of an increase in an amount of fuel at restart of the internal combustion engine from a predetermined standard value, wherein the increase in the amount of fuel at restart of the internal combustion engine has an initial value that is equal to an increase in the amount of fuel that existed at the time when an operation of the internal combustion engine was temporarily stopped.

2. A method of operating a vehicular internal combustion engine which is designed to increase an amount of fuel temporarily at start, wherein:

if a time that elapses, from a timing when the internal combustion engine is started through a timing when the internal combustion engine is stopped temporarily and then to a timing when the internal combustion engine is restarted, is shorter than a predetermined value, the method of comprising the step of:

reducing an initial value of an increase in an amount of fuel at restart of the internal combustion engine from a predetermined standard value, wherein the increase in the amount of fuel is calculated on the basis of an estimated amount of fuel that has adhered to the perimeter of intake ports of the internal combustion engine at start of the internal combustion engine, the amount of fuel that has adhered to the perimeter of the intake ports is estimated on the basis of another time that elapses after stoppage of the internal combustion engine, and the estimated amount of fuel that has adhered to the perimeter of the intake ports is expressed by an equation $Kfr=Kfr_0-\Delta Kfr\cdot C2$, in which Kfr, $Kfr_0$, ΔKfr, and C2 represent a liquid-fuel membrane coefficient, an initial value of the liquid-fuel membrane coefficient, a change in the liquid-fuel membrane coefficient, and a time that has elapsed after stoppage of the internal combustion engine, respectively.

3. A method of operating a vehicular internal combustion engine which is designed to increase an amount of fuel temporarily at start, wherein:

if a time that elapses, from a timing when the internal combustion engine is started through a timing when the internal combustion engine is stopped temporarily and then to a timing when the internal combustion engine is restarted, is shorter than a predetermined value, the method of comprising the step of:

reducing an initial value of an increase in an amount of fuel at restart of the internal combustion engine from a predetermined standard value, wherein the increase in the amount of fuel is expressed by an equation $Kfs=Kfs_0-\Delta Kfs\cdot C1-Ka-Kfr$, in which Kfs, $Kfs_0$, ΔKfs, and C1 represent the increase in the amount of fuel, the initial value of the increase in the amount of fuel, a change in the increase in the amount of fuel, and a time that has elapsed after stoppage of the internal combustion engine, respectively.

4. A method of operating a vehicular internal combustion engine which is designed to increase an amount of fuel temporarily at start, wherein:

if an amount of air that flows through intake ports of the internal combustion engine, from a timing when the internal combustion engine is started through a timing when the internal combustion engine is stopped temporarily and then to a timing when the internal combustion engine is restarted, is smaller than a predetermined value, the method comprising the step of:

reducing an initial value of an increase in an amount of fuel at restart of the internal combustion engine from a predetermined standard value.

5. The method according to claim 4, wherein:

the internal combustion engine is of an intermittent-operation type and can be stopped temporarily if a predetermined vehicle-operating condition is fulfilled while the vehicle is running.

6. The method according to claim 4, wherein:

the increase in the amount of fuel at restart of the internal combustion engine is reduced gradually as time elapses after the internal combustion engine is restarted.

7. The method according to claim 4, wherein:

the increase in the amount of fuel at restart of the internal combustion engine has an initial value that is equal to an increase in the amount of fuel that existed at the time when an operation of the internal combustion engine was temporarily stopped.

8. The method according to claim 4, wherein:

the initial value of the increase in the amount of fuel at restart of the engine is obtained by subtracting a correction value from the predetermined standard value, and wherein the correction value is reduced gradually with the lapse of time from a timing when the internal combustion engine is stopped to a timing when the internal combustion engine is restarted.

9. The method according to claim 4, wherein:

the increase in the amount of fuel is calculated on the basis of an estimated amount of fuel that has adhered to the perimeter of intake ports of the internal combustion engine at start of the internal combustion engine.

10. The method according to claim 9, wherein:

the amount of fuel that has adhered to the perimeter of the intake ports is estimated on the basis of another time that elapses after stoppage of the internal combustion engine.

11. A method of operating a vehicular internal combustion engine which is designed to increase an amount of fuel temporarily at start, wherein:

if a time that elapses, from a timing when the internal combustion engine is stopped to a timing when the internal combustion engine is restarted, is shorter than a predetermined value, the method comprising the step of:

refraining from increasing the amount of fuel at restart of the internal combustion engine.

12. The method according to claim 11, wherein:

the internal combustion engine is an intermittent-operation type and can be stopped temporarily if a predetermined vehicle-operating condition is fulfilled while the vehicle is running.

* * * * *